US007510019B2

(12) United States Patent
Li et al.

(10) Patent No.: US 7,510,019 B2
(45) Date of Patent: Mar. 31, 2009

(54) FORMING A METAL-TO-METAL SEAL IN A WELL

(75) Inventors: Yanmei Li, Pearland, TX (US); Daniel M. Torbett, Sugar Land, TX (US); Andrew T. Werner, East Bernard, TX (US); James D. Hendrickson, Sugar Land, TX (US); Nathan Kathol, Chestermere (CA); Vi Nguy, Calgary (CA)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/734,112

(22) Filed: Apr. 11, 2007

(65) Prior Publication Data

US 2008/0061510 A1 Mar. 13, 2008

Related U.S. Application Data

(60) Provisional application No. 60/825,179, filed on Sep. 11, 2006.

(51) Int. Cl.
*E21B 33/12* (2006.01)

(52) U.S. Cl. ..... 166/387; 277/343

(58) Field of Classification Search ..... 166/387; 277/343

See application file for complete search history.

(56) References Cited

U.S. PATENT DOCUMENTS 3,915,462 A * 10/1975 Bruns et al. ..... 277/647
4,264,054 A * 4/1981 Morrill ..... 251/328
4,288,082 A * 9/1981 Setterberg, Jr. ..... 277/342
5,129,660 A * 7/1992 Taylor et al. ..... 277/328
5,176,409 A * 1/1993 Brooks ..... 285/94
5,211,226 A 5/1993 Hendrickson
5,246,236 A * 9/1993 Szarka et al. ..... 277/337
5,685,369 A 11/1997 Ellis
5,787,987 A 8/1998 Forsyth
5,988,273 A * 11/1999 Monjure et al. ..... 166/75.14
6,032,958 A 3/2000 Fowler
6,513,600 B2 2/2003 Ross
6,561,521 B2 * 5/2003 Janoff et al. ..... 277/603
6,752,397 B2 6/2004 Kohli
6,772,844 B2 8/2004 Lloyd
6,779,602 B1 * 8/2004 Van Bilderbeek et al. ... 166/216
6,896,049 B2 5/2005 Moyes
7,134,506 B2 11/2006 Moyes
2005/0213898 A1 9/2005 Rubinstein
2006/0260820 A1 11/2006 Whitsitt

FOREIGN PATENT DOCUMENTS

GB 2379686 A 3/2003
GB 2417271 A 2/2006
GB 2429473 A 2/2007
WO 0204783 A1 1/2002
WO 2005022012 A1 3/2005

* cited by examiner

*Primary Examiner*—William P Neuder
(74) *Attorney, Agent, or Firm*—James L. Kurka; Jeremy P. Welch; Trop, Pruner, Hu, P.C.

(57) ABSTRACT

A seal assembly that is usable with a well includes a metal body that is adapted to expand radially inwardly and radially outwardly in response to the body being longitudinally compressed between compressing surfaces. The metal body includes first and second surfaces that do not conform to the compressing surfaces before longitudinal compression of the body and are adapted to contact the compressing surfaces.

23 Claims, 7 Drawing Sheets

FORMING A METAL-TO-METAL SEAL IN A WELL

This application claims the benefit under 35 U.S.C. § 119 (e) to U.S. Provisional Application Ser. No. 60/825,179, entitled, "SPECIAL ENERGIZED METAL-TO-METAL SEAL FOR DOWN HOLE STATIC SEAL APPLICATION," which was filed on Sep. 11, 2006, and is hereby incorporated by reference in its entirety.

BACKGROUND

The invention generally relates to forming a metal-to-metal seal in a well.

Polymer seals, which include rubber and plastic seals, are commonly used in downhole tools. Polymer seals are often used due to their flexibility, resilience and their ability to seal uneven or irregular surfaces. However, for some downhole environments, such as environments that present extremely high or low temperatures or corrosive fluids (as examples), conventional polymer materials may not be suitable. Furthermore, even in applications in which polymer seals may be used, material degradation, failure and property variations due to environmental changes may make the use of polymer seals challenging. A backup system typically is used with a polymer seal due to the seal's poor anti-extrusion resistance.

A metal seal may be used in a downhole application in place of a polymer seal. Metal seals generally exhibit superior stable mechanical and physical properties, as compared to polymer seals. However, seal design typically is more challenging for metal seals because the sealing mechanism is different from that of polymer seals. For example, a metal seal typically requires significantly more surface finishing and significantly more contact stress on the sealing surface.

SUMMARY

In an embodiment of the invention, a seal assembly that is usable with a well includes a metal body that is adapted to expand radially inwardly and radially outwardly in response to the body being longitudinally compressed between compressing surfaces. The metal body includes first and second surfaces that do not conform to the compressing surfaces before longitudinal compression of the body and are adapted to contact the compressing surfaces.

Advantages and other features of the invention will become apparent from the following drawing, description and claims.

DETAILED DESCRIPTION

Figure 1:
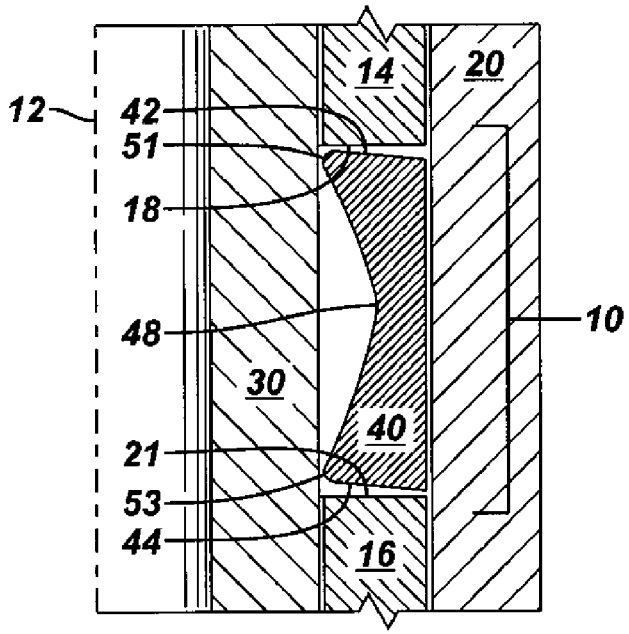
FIG. 1 is a schematic diagram illustrating a cylindrical-type metal seal assembly before a metal seal ring of the assembly is set according to an embodiment of the invention.

Referring to FIG. 1, a metal seal assembly 10 in accordance with embodiments of the invention may be used to form a seal between an inner tubular member 30 and an outer tubular member 20 in a well. As an example, the outer tubular member 20 may be a casing string, and the inner tubular member 30 may be a work or production string, although the tubular members 20 and 30 may be different components in other embodiments of the invention.

Both tubular members 20 and 30 are generally concentric with and generally extend along a longitudinal axis 12 of the well. In general, the metal seal assembly 10 includes a cylindrical and metallic seal ring 40, which has a thickness profile and other geometrical features that cause the ring 40 to expand both radially inwardly and radially outwardly when longitudinally compressed to form the seal between the tubular members 20 and 30.

As depicted in FIG. 1, the longitudinal compression of the seal ring 40 may be achieved using upper 14 and lower 16 thimbles, or gauges, in accordance with some embodiments of the invention. In general, the gauges 14 and 16 may have relatively flat annular surfaces 18 and 21, respectively, for purposes of engaging upper 42 and lower 44 surfaces, respectively, of the seal ring 40. Unlike the flat surfaces 18 and 21, the surfaces 42 and 44 of the seal ring 40 are inclined, another feature of the seal ring 40, which causes the seal ring 40 to buckle when longitudinally compressed.

Figure 1A:
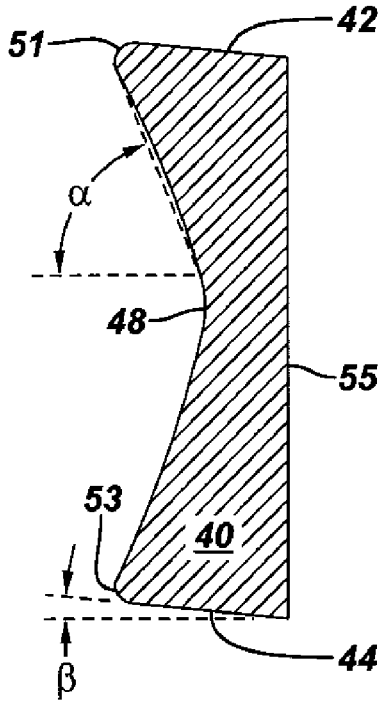
FIG. 1A is an enlarged view of the seal ring of FIG. 1 according to an embodiment of the invention.

Referring to FIG. 1A, in accordance with some embodiments of the invention, the radial thickness of the seal ring 40 varies from its ends where the ring 40 is the thickest to the midsection 48 wherein the ring 40 is the thinnest. Other thickness variations for the seal ring 40 (a uniform thickness for the seal ring, for example) are contemplated and are within the scope of the appended claims.

To achieve thickness variations, the inner surface of the seal ring may be sloped with respect to a reference horizontal line at an angle $\alpha$. The upper 42 and lower 44 surfaces of the seal ring 40 may each be sloped with respect to the reference horizontal line by a smaller angle $\beta$.

Figure 2:
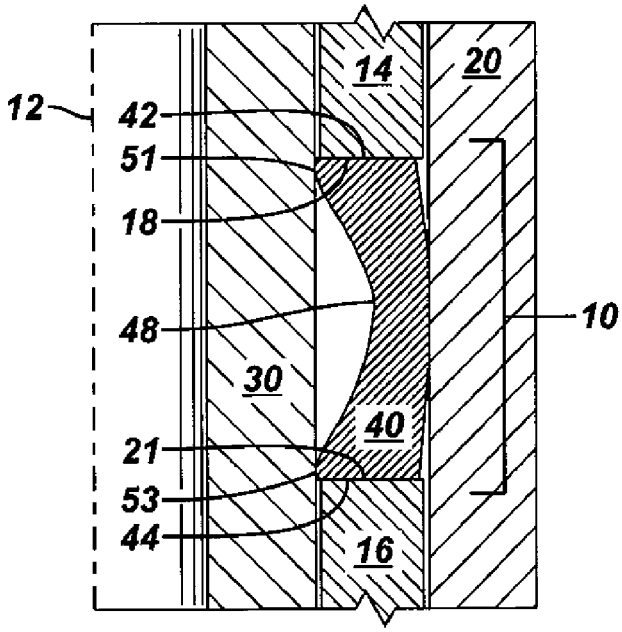
FIG. 2 is a schematic diagram of the metal seal assembly of FIG. 1 after the metal seal ring is set according to an embodiment of the invention.

Referring to FIG. 2, when the seal ring 40 is longitudinally compressed, inner rounded surfaces 51 and 53 of the seal ring 40 contact and generally form seals with the outer surface of the inner tubular member 30. Additionally, the outer surface of the seal ring 40 near the midsection of the ring 40 forms a corresponding sealing contact 55 between the seal ring 40 and the inner surface of the outer tubular member 20. As also depicted in FIG. 2, when the seal ring 40 is longitudinally compressed, the upper 42 and lower 44 surfaces of the ring 40 generally conform to the corresponding gauge surfaces 18 and 21, respectively.

In accordance with some embodiments of the invention, the seal ring 40 may be primarily formed from annealed copper material and may have a longitudinal dimension of approximately seven inches. The extrusion gap may be approximately 0.178 inches diametrically. The seal ring 40 may be made from other material and may have different dimensions, in accordance with other embodiments of the invention. For example, instead of copper, other materials for the seal ring 40 may be selected for any number of reasons, such as corrosive effects, strength, cost, etc. As a more specific example, a seal element that is made from nickel or a nickel alloy may have increased suitability for corrosive environments. As further described above, the seal element may be formed from different metals, which are selected for performing different functions.

The seal ring 40 may have a variety of different inner diameters, outer diameters, lengths, outer side angles and inner side angles, depending on the particular embodiment of the invention. The particular ring size may be determined by the inner diameter of the outer tubular member 20, the gauge 16, 18 outer diameter and a mandrel outer diameter, or different combinations of the above. The $\alpha$ angle (see FIG. 1A) at which the thickness of the seal ring 40 changes as well as the $\beta$ incline angle of the surface 42, 44 may vary between ten and seventy degrees (as examples), depending on the particular embodiment of the invention. The outer side angle may be the same or different from the inner side angle, depending on the particular embodiment of the invention. These angles impart thickness variations to aid in achieving the desirable seal deformation. Thus, many variations are contemplated and are within the scope of the appended claims.

Figure 3:
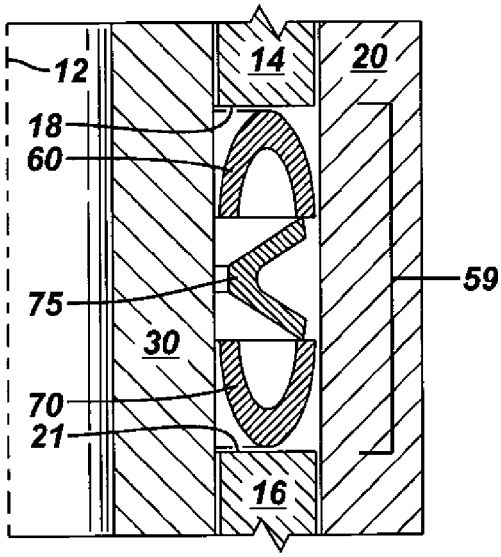
FIGS. 3, 5, 7 and 9 are schematic diagrams depicting metal seal assemblies that include metal seal rings before the seal rings are set according to embodiments of the invention.

FIG. 3 depicts a metal seal assembly 59, which may be used in place of the metal seal assembly 10 in accordance with some embodiments of the invention. Referring to FIG. 3, the seal assembly 59 includes upper 60 and lower 70 metal seal rings, each of which has a curved radial cross-section. The upper seal ring 60 is concave toward an energizing ring 75 (of the seal assembly 59) that is disposed between the rings 60 and 70; and the lower seal ring 70 is located below the energizing ring 75 and is also concave with respect to the ring 70. As depicted in FIG. 3, the energizing ring 75 generally has a V-shaped radial cross section. In general, the vertex of the cross-section of the energizing ring 75 is located near the outer surface of the inner tubular member 30 in accordance with some embodiments of the invention. It is noted that the cross-sectional shape of the seal ring 60, 70 is depicted as an example, as the seal ring may be elliptical, V-shaped hemicircular or other shapes, depending on the particular embodiment of the invention. Regardless of the particular profile, the seal ring 60, 70 opens up in both radially inward and radially outward directions. Therefore, longitudinal pressure may be applied by the gauges 14 and 16 to deform the seal elements 60, 70 to achieve relatively high contact stress and better sealing performance.

Figure 4:
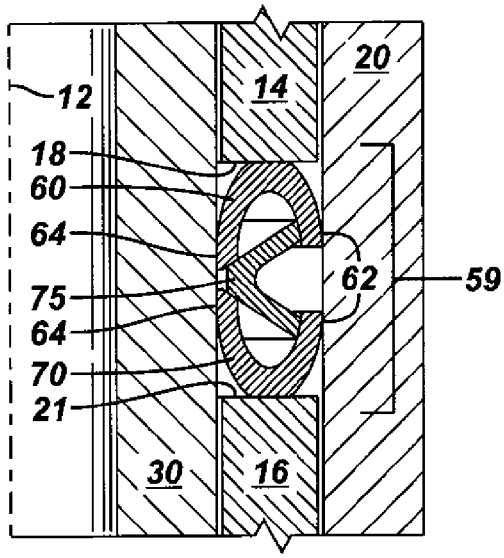
FIGS. 4, 6, 8 and 10 are schematic diagrams depicting the seal assemblies of FIGS. 3, 5, 7 and 9, respectively, after the metal seal rings of the assemblies are set according to embodiments of the invention.

Although the energizing ring 75 is depicted in FIG. 3 as being V-shaped, it is noted that the energizing ring 75 may have other cross-sectional profiles, depending on the particular embodiment of the invention. For example, depending on the particular embodiment of the invention, the energizing ring 75 may have a rectangular, trapezoidal or other radial cross-sectional shape. The combination of the seal ring(s) and the energizing ring(s) allows the seal ring to deform and seal on both the inner and outer surfaces of the tubular members 20 and 30, respectively. FIG. 4 depicts the seal assembly 59 of FIG. 3 when the seal rings 60 and 70 are longitudinally compressed to form sealing contacts 62 and 64 with the inner surface of the outer tubular member 20 and the outer surface of the tubular member 30, respectively.

Figure 5:
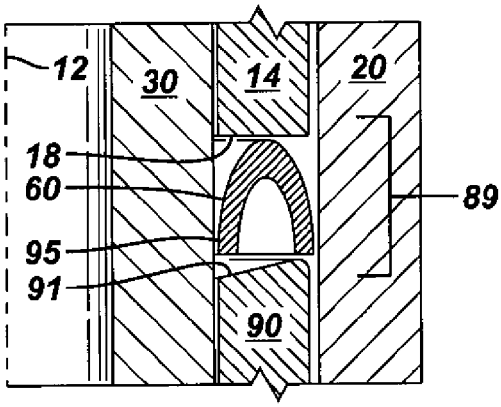
Figure 6:
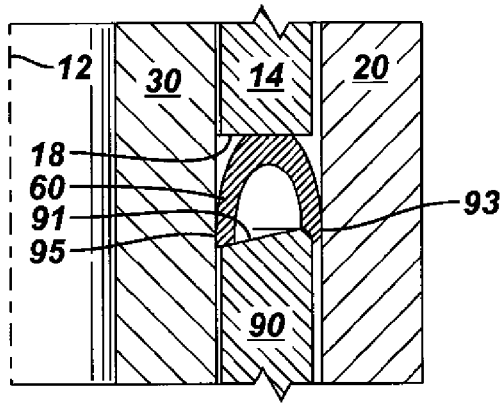

FIG. 5 depicts a metal seal assembly 89, which may be used in accordance with other embodiments of the invention. As compared to the seal assembly 59 of FIGS. 3 and 4, the seal assembly 89 includes a single curved seal ring 60, which has the same orientation as the seal ring 60 of the assembly 59. The seal assembly 89 includes an energizing ring 90, which is located below the seal ring 60 and has a trapezoidal radial cross-section so that the seal ring 60 is compressed between the relatively flat surface 18 of the upper gauge 14 and a relatively inclined surface 91 of the energizing ring 90. The seal ring 60 deforms as depicted in FIG. 6 when set to form an outer sealing contact 93 and an inner sealing contact 95.

Figure 7:
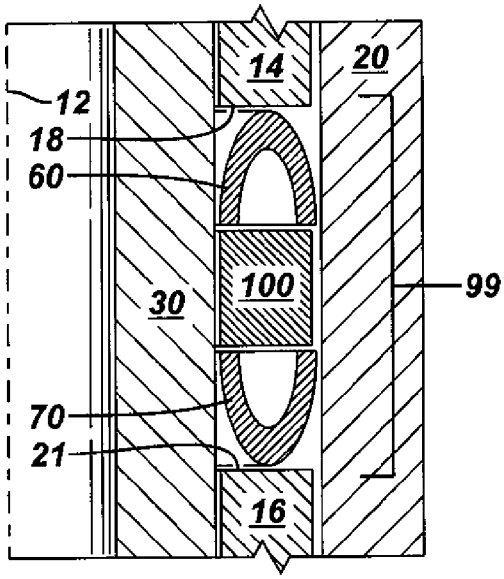
Figure 8:
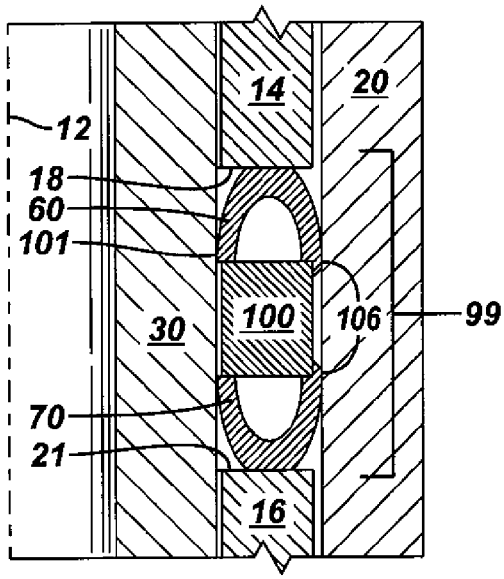

Referring to FIG. 7, in accordance with other embodiments of the invention, the upper 60 and lower seal rings 70 may be used in another metal seal assembly 99, which has a design similar to the metal seal assembly 59 of FIG. 3. However, in the seal assembly 99, the energizing ring 75 is replaced with an energizing ring 100, which has a square radial cross section. The seal rings 60 and 70 deform as depicted in FIG. 8 to form inner 101 and outer 106 sealing contacts.

Figure 9:
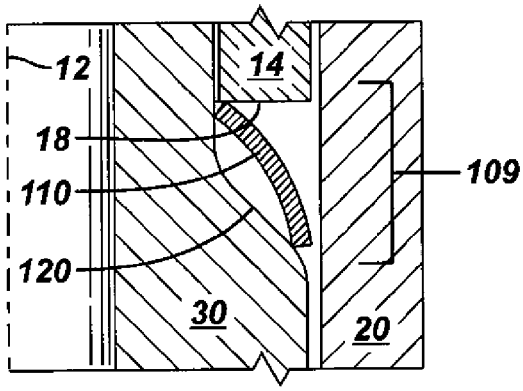
Figure 10:
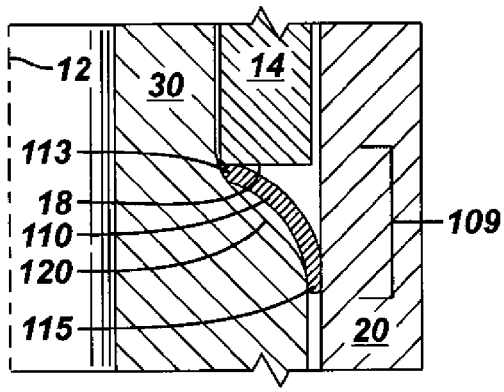

Referring to FIG. 9, in yet another variation, a metal seal assembly 109 includes a curved seal ring 110 that is longitudinally compressed between the upper gauge 14 and a curved, or ramped, surface 120 of the inner tubular member 30. Alternatively, the surface 120 may be part of a lower gauge separate from the inner tubular member 30, in accordance with embodiments of the invention. Movement of the upper gauge 14 with respect to the surface 120 compresses the curved seal ring 110, as shown in FIG. 10 to produce inner 113 and outer 115 sealing contacts.

Figure 11:
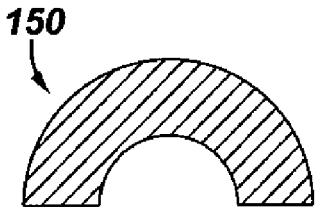
FIGS. 11 and 12 are cross-sectional diagrams of seal rings according to embodiments of the invention.
Figure 12:
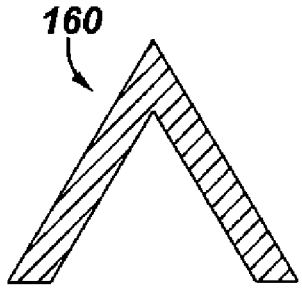

As examples of other potential seal element designs, FIGS. 11 and 12 depict a circularly curved ring 150 and a V-shaped seal ring 160, respectively, in accordance with other embodiments of the invention. The seal ring 150 has a circular radius such that the ring 150 is concave with respect to the energizing element (not shown). The seal ring 160 of FIG. 12 has its vertex contacting the energizing element (not shown in FIG. 12) or upper gauge before deformation of the element 160.

Figure 13:
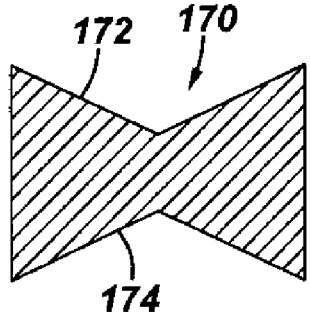
FIGS. 13, 14 and 15 are cross-sectional diagrams of energizing rings according to embodiments of the invention.
Figure 14:
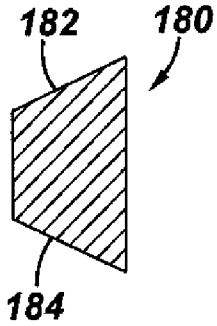
Figure 15:
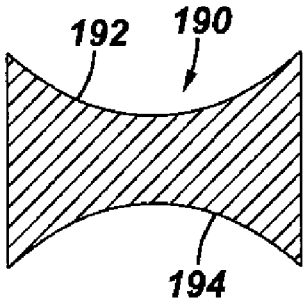

As examples of other possible energizing ring designs in accordance with embodiments of the invention, FIG. 13 depicts an energizing ring 170, which includes an upper V-shaped surface and a lower V-shaped surface 174. FIG. 14 depicts an energizing ring 180, of a different radial trapezoidal cross-section having upper 182 and lower 184 inclined surfaces. FIG. 15 depicts an energizing ring 190, which includes a curved upper surface 190 and a curved lower surface 194. As can be seen, many variations are contemplated, and all of which are within the scope of the appended claims.

The seal ring may be formed of soft metals, like copper, nickel or any other material with low yield stress. A benefit of using soft metal is that the seal deforms relatively easily with low setting forces. Another benefit in using soft metal is that the seal conforms to a rough sealing surface. In other embodiments of the invention, the seal element may be formed from high yield metals. In these embodiments of the invention, the seal deformation may be reversible if the element is deformed in its elastic region.

The energizing ring may also be formed from a high yield and high strength metal because it is used to energize the seal element and support after seal deformation. Shaped memory alloys may also be used with and without energizing rings. The additional advantage of using shaped memory alloys is the alloys may be allowed to change shapes depending on the external stimuli, such as temperature, electromagnetic field, etc.

Figure 16:
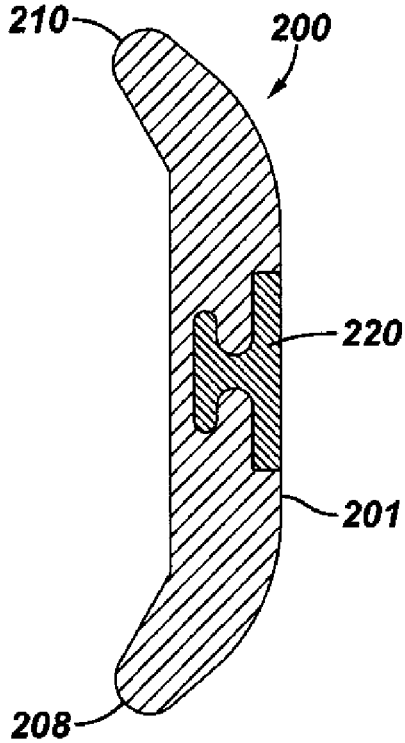
FIG. 16 depicts a cross-sectional view of a seal element made from two different metals according to an embodiment of the invention.

Referring to FIG. 16, in accordance with some embodiments of the invention, a seal ring 200 may be formed from both soft and high yield metals. In this regard, one part 201 of the seal element 200 may be formed from a high yield metal, which is elastic and includes rounded portions 210 and 208 to form sealing contacts. The seal element 200 also includes a soft metal to form a soft metal contact 220, which is embedded in the part 201 to form a sealing contact on the inner surface of the outer tubular member 20.

Figure 17:
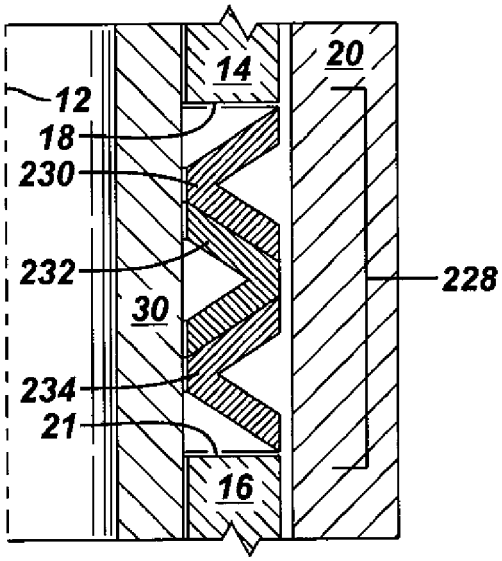
FIG. 17 depicts a seal assembly having a seal element formed from two different metals according to an embodiment of the invention before the seal element is set.
Figure 18:
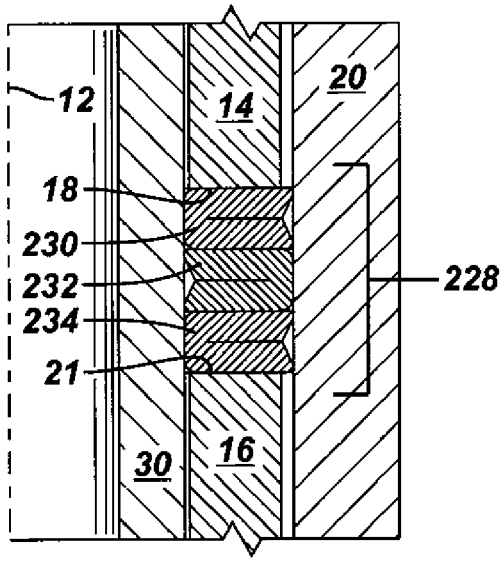
FIG. 18 depicts the seal assembly of FIG. 17 after the assembly is set according to an embodiment of the invention.

As another example, FIG. 17 depicts a seal assembly 228, which has top 230, middle 232 and bottom 234 seal rings, which may be formed from different metals to serve different functions. For example, one or more of the rings 230, 232 and 234 may be formed from a metal that is suitable for anchoring the seal assembly 228 (for packer and bridge plug applications); and/or one of more of the rings 230, 232 and 234 may be formed from a metal that is suitable for forming a seal between the inner 30 and outer 20 tubular members when the seal assembly 228 is compressed (FIG. 18). Thus, in accordance with some embodiments of the invention, one or more of the rings 230, 232 and 234 may anchor a particular downhole component to a wellbore wall or well casing, depending on whether the well is cased. As depicted in FIG. 17, all three rings 230, 232 and 234 may have V-shaped cross-sections, with the top 230 and bottom 234 rings opening toward the outer tubular member 20 and the middle ring 232 opening toward the inner tubular member 30 (as a non-limiting example).

The seal assembly 228 may contain different metals for redundancy purposes. Because the seal assembly 228 may function as an anchoring device for packer and bridge plug applications, conventional slips may be eliminated. The seal element may be welded onto the seal surfaces due to high contact stress.

In accordance with some embodiments of the invention, part of the seal assembly may have an array of annular grooves to enhance the interaction between the seal and contact surface and to improve the anchoring effect as well. Other advantages such as low setting force and good swab-off resistance may also be achieved using these metal seals.

Holes may be drilled through on one side of seal, for purposes of not interfering with the sealing function. The drilled holes may help bleed off trapped pressure inside cavity between seal and inner tubular sealing surfaces. The holes may also help pressure energize the seal under differential pressure holds. Likewise, having one side of the seal open ended will accomplish the same result, allowing well bore pressure, and/or applied differential pressure to further enhance sealing capabilities. This would be similar in application to that of a packer cup.

The seal designs that are set forth herein may also be used with polymer material, e.g., part of metal seal element can be coated with rubber or plastic material. The advantage of this type of seal will be high contact stress that cannot be achieved with polymer seals only. In this application, seal is activated by applying axial compressive load or other methods, such as heat for seals made of shape memory alloys.

For some seal applications involving tool or small seal movement, a special device with spring type mechanism may be incorporated since metal-to-metal seals may have reduced flexibility for the movement.

Figure 19:
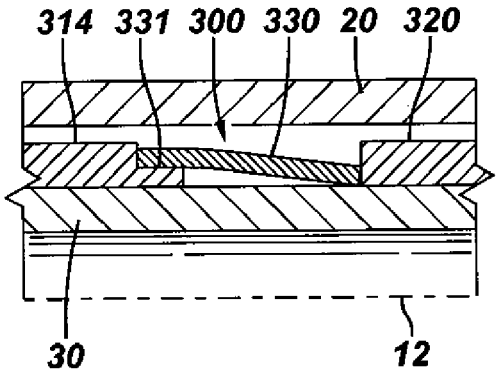
FIGS. 19, 21, 23, 25 and 27 depict different seal assemblies before seal rings of the assemblies are set according to embodiments of the invention.
Figure 20:
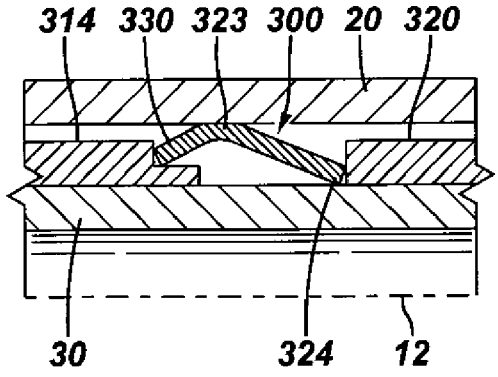
FIGS. 20, 22, 24, 26 and 29 depict the seal assemblies of FIGS. 19, 21, 23, 25 and 27, respectively, after the seal rings of the seal assemblies are set according to embodiments of the invention.

Other variations are contemplated and are within the scope of the appended claims. For example, FIG. 19 depicts a metal seal assembly 300 in which a seal ring 330 is compressed between two gauges 314 and 320. The upper end of the seal ring 330 is received in a shoulder 331 that is formed in the lower end of the gauge 314 to cause the seal ring 330 to deform when compressed, as depicted in FIG. 20. The seal ring 330 may be attached or unattached to the gauge 314, depending on the particular embodiment of the invention. As shown in FIG. 20, when compressed, a middle point 323 of the compressed seal ring 330 forms a seal with the inner surface of the outer tubular member 20; and an end 324 of the seal ring 330 forms a seal point with the outer surface of the inner tubular member 30.

Figure 21:
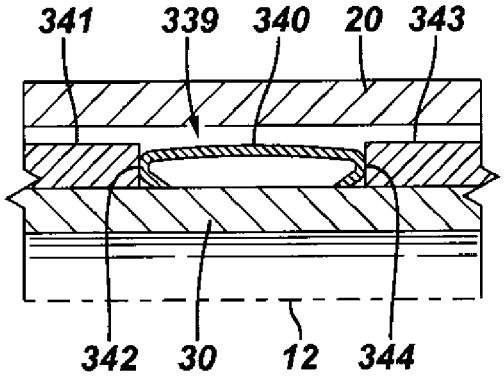
Figure 22:
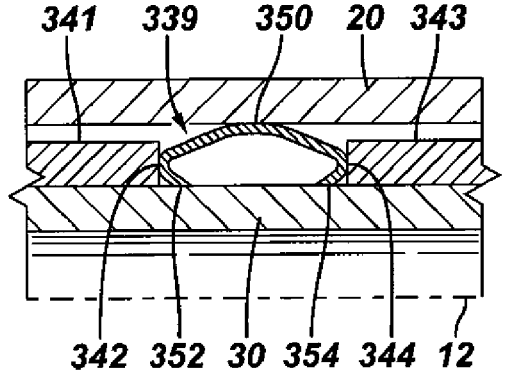

Referring to FIG. 21, as an example of another variation, a seal ring 340 of a seal assembly 339 may be longitudinally compressed between gauges 341 and 343. The seal ring 340 is bent, or curved at its ends 342 and 344, which form corresponding seal contacts 352 and 354, respectively, as depicted in FIG. 22, when the seal element 340 is longitudinally compressed. Additionally, a midpoint of the seal ring 340 forms a seal contact 350 (see FIG. 22) with the inner surface of the outer tubular member 20 when the ring 340 is compressed.

Figure 23:
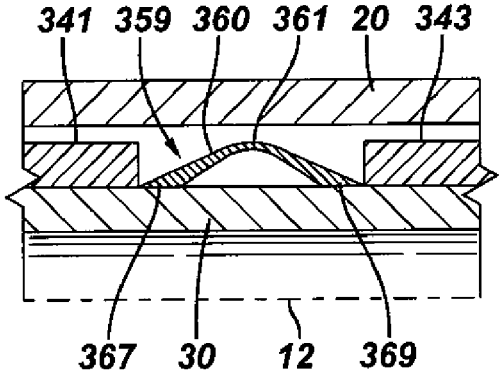
Figure 24:
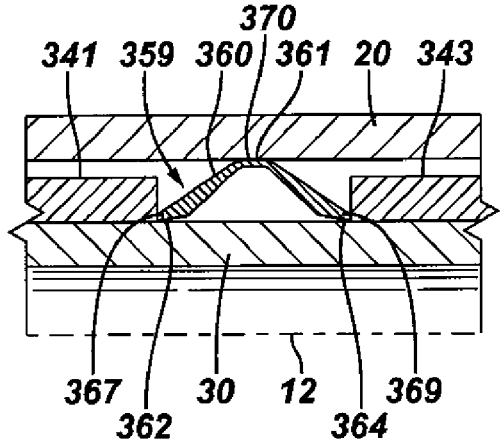

Referring to FIG. 23, in accordance with other embodiments of the invention, a seal ring 360 of a metal seal assembly 359 may be generally radially bowed outwardly so that a center, or midsection 361, of the seal ring 360 has the maximum radius. Referring also to FIG. 24, when longitudinally compressed, seal contacts 362 and 364 are formed at ends 367 and 369 of the seal ring 360, with the midpoint 361 of the seal ring 360 forming a seal contact 370 with the inner surface of the outer tubular member 20.

Figure 25:
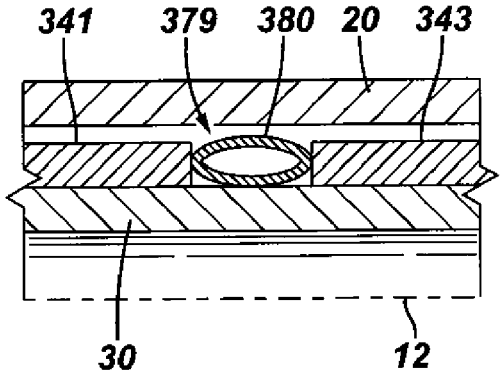
Figure 26:
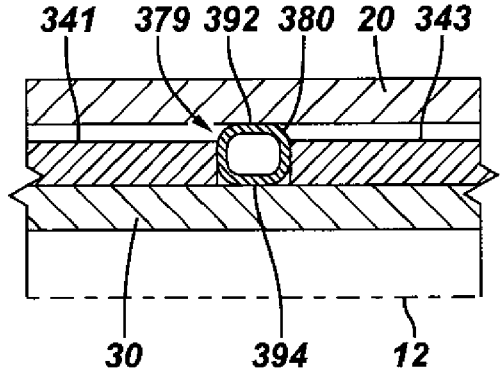

Referring to FIG. 25 in yet another variation, a seal ring 380 of a metal seal assembly 379 may be an annularly disposed tubular ring, in accordance with some embodiments of the invention. In this regard, the seal ring 380 may be heated and radially compressed until an oval cross-section is achieved; and then, the seal ring 380 may be annealed in order to obtain the required hardness. When the seal ring 380 is compressed, as depicted in FIG. 26, the setting force returns the ring 380 back to its circular cross-section (or at least a slight oval cross-section) to form sealing contact 392 and 394 with the outer 20 and inner 30 tubular members, respectively.

Figure 27:
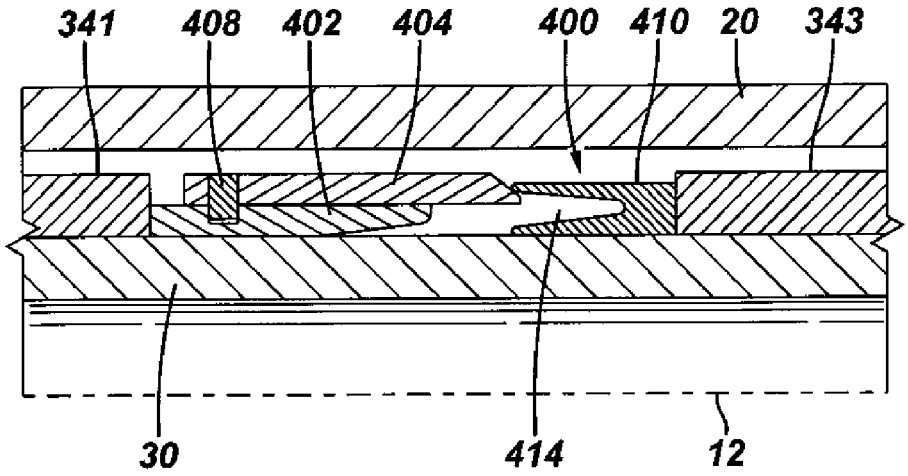

As an example of another variation, FIG. 27 depicts a metal seal assembly 400 in accordance with other embodiments of the invention. The seal assembly 400 includes a V-shaped radial cross-section metal seal ring 410 that includes a V-shaped opening 414 to receive a outer cone 404. The outer cone 404 is attached to an inner cone 402 by a shear screw 408.

Figure 28:
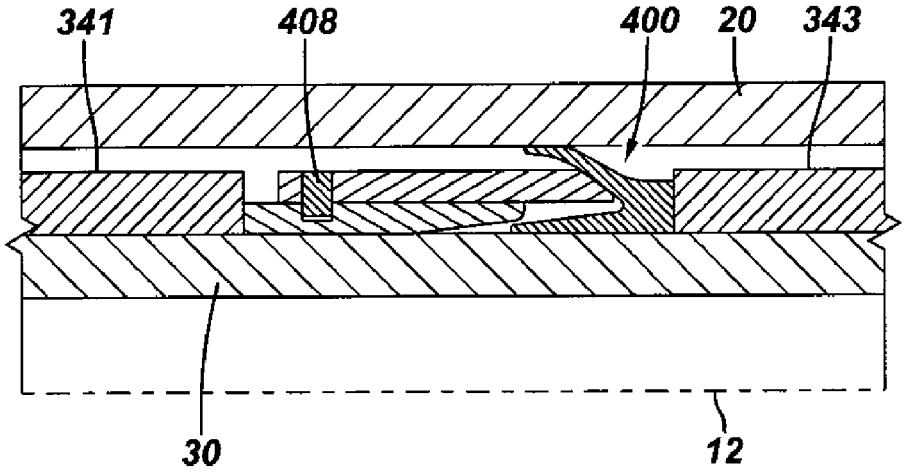
FIG. 28 depicts an intermediate state of the seal assembly of FIGS. 27 and 29 during the setting of the seal assembly according to an embodiment of the invention.
Figure 29:
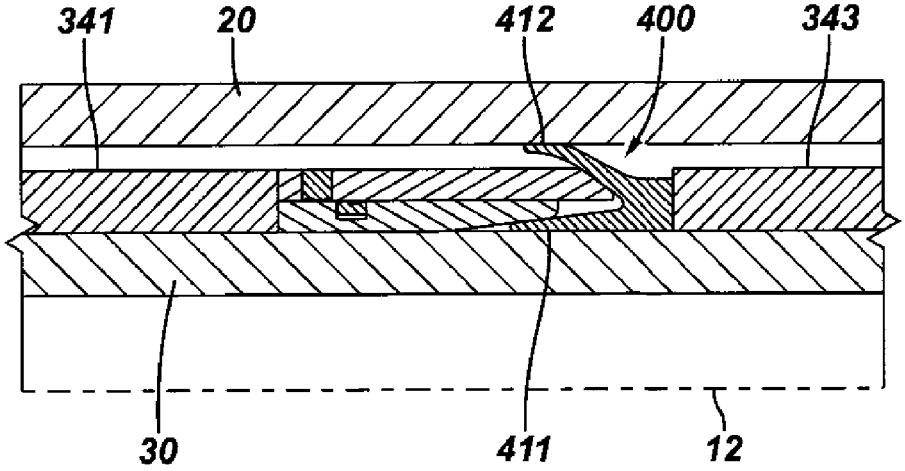

Referring to FIG. 28 (which depicts an intermediate state during the setting of the seal assembly 400), when the seal element 410 is initially compressed, the outer cone 404 contacts the seal element 410 first, forcing the element 410 to contact the inner surface of the outer tubular member 20. Referring to FIG. 29, when the setting force exceeds the shear value of the screw 408, the inner cone 402 is rammed into the seal element 410, thereby forming sealing contacts 412 and 411 with the outer 20 and inner 30 tubular members, respectively.

Another approach involves a two set step that would independently drive the element 410 to the outer tubular member 20 in one step, and drive the element 410 into the inner tubular member 30 in the another step (the order is not important). This could lead to a solution that would decrease the setting force by eliminating the combined drag force of current ring designs, by eliminating the simultaneous drag of the ring on both tubular member 20 and 30 during the setting process.

The metal seal assemblies, which are disclosed herein may be used for numerous applications in the downhole environment, such as bridge plugs, straddles, retrofit locks, sliding sleeves, communications orifice & sleeves, liner hangers, permanent & retrievable packers, spool tree plugs, polished bore receptacle (PBR), seal assemblies, lateral windows & junctions, surface pressure control equipment, wireline stuffing boxes & grease injection heads, sub-sea riser, as just a few examples.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A seal assembly usable in a subterranean well, comprising:

a metal body adapted to expand radially inwardly and radially outwardly in response to the body being longitudinally compressed between compressing surfaces to form an annular seal in the subterranean well, the metal body comprising first and second surfaces that do not conform to the compressing surfaces before longitudinal compression of the body and are adapted to contact the compressing surfaces, wherein the metal body has a radial thickness that varies along a longitudinal length of the metal body, and the thickness is thinner near a longitudinal midpoint of the metal body than near either end of the metal body.

2. The seal assembly of claim 1, wherein the first and second surfaces are inclined with respect to the compressing surfaces.

3. The seal assembly of claim 1, wherein the metal body comprises a cylindrical body.

4. The seal assembly of claim 1, wherein the first and second surfaces substantially conform to the compressing surfaces in response to the metal body being longitudinally compressed.

5. The seal assembly of claim 1, wherein one of the compressing surfaces comprises a surface of an energizing ring.

6. The seal assembly of claim 1, wherein at least one of the compressing surfaces has a ramped profile.

7. The seal assembly of claim 1, wherein the metal body is adapted to anchor a downhole component to at least one of a wellbore wall and a well casing.

8. A seal assembly usable in a subterranean well, comprising:

at least one member to be remotely activated in the subterranean well to exert a longitudinal compressive force, the member comprising a first surface; and a metal body adapted to expand radially inwardly and radially outwardly in response to the longitudinal force to form an annular seal in the subterranean well, the metal body comprising a second surface that substantially conforms to the first surface when the metal body is compressed, wherein the seal assembly comprises a seal assembly for one of a packer and a bridge plug.

9. The seal assembly of claim 8, wherein the first and second surfaces are inclined with respect to each other.

10. The seal assembly of claim 8, wherein the metal body comprises a cylindrical body.

11. The seal assembly of claim 10, wherein the metal body has a radial thickness that varies along a longitudinal length of the metal body.

12. The seal assembly of claim 11, wherein the thickness is thinner near a longitudinal midpoint of the cylindrical body than near either end of the cylindrical body.

13. The seal assembly of claim 8, wherein one of the first and second surfaces comprises an energizing ring.

14. The seal assembly of claim 13, wherein the energizing ring comprises a ring having a trapezoidal cross-section.

15. The seal assembly of claim 13, wherein the energizing ring comprises a ring having a rectangular cross-section.

16. A method usable in a subterranean well, comprising:

providing a metal body to form a seal in the subterranean well when the metal body is longitudinally compressed along a longitudinal axis, the metal body comprising a tubular passageway that circumscribes the longitudinal axis;

forming a surface of the metal body that does not substantially conform to a compressing surface prior to the longitudinal compression of the metal body; and exerting a longitudinal force against the surface of the metal body to longitudinally compress the metal body.

17. The method of claim 16, further comprising:

inclining the surface of the metal body with respect to the compressing surface.

18. The method of claim 16, wherein the act of providing a metal body comprises providing a cylindrical body.

19. The method of claim 18, wherein the act of providing a metal body comprises providing a metal body that has a radial thickness that varies along a longitudinal length of the metal body.

20. The method of claim 19, wherein the radial thickness is thinner near a longitudinal midpoint of the cylindrical body than near either end of the cylindrical body.

21. The method of claim 16, wherein the act of providing comprises providing a metal body that has substantially rounded surfaces to form seals between a first member located radially inside the body and a second member located radially outside of the body.

22. The method of claim 16, further comprising:

using the metal body to form an anchor in the well.

23. A seal assembly usable in a well, comprising:

a metal body adapted to expand radially inwardly and radially outwardly in response to the body being longitudinally compressed along a longitudinal axis between compressing surfaces, the metal body comprising first and second surfaces that do not conform to the compressing surfaces before longitudinal compression of the body and are adapted to contact the compressing surfaces, wherein the metal body comprises a tubular ring defining a closed passageway that circumscribes the longitudinal axis.

* * * * *